US005368096A

United States Patent [19]

Williams

[11] Patent Number: 5,368,096

[45] Date of Patent: Nov. 29, 1994

[54] CONDENSING HEAT EXCHANGER SCRUBBING SYSTEM

[75] Inventor: Paul J. Williams, Akron, Ohio

[73] Assignee: The Babcock & Wilcox Company, New Orleans, La.

[21] Appl. No.: 161,109

[22] Filed: Dec. 2, 1993

[51] Int. Cl.[5] ..... F28B 1/02; F28B 5/00

[52] U.S. Cl. ..... 165/113; 165/119; 165/913; 55/268

[58] Field of Search ..... 165/113, 913, 119; 55/268

[56] References Cited

U.S. PATENT DOCUMENTS 4,339,249 7/1982 Berkestad et al. ..... 55/269

4,619,671 10/1986 Ruff et al. ..... 55/269

5,154,742 10/1992 Gault et al. ..... 55/269

*Primary Examiner*—Albert W. Davis, Jr.

*Attorney, Agent, or Firm*—Robert J. Edwards; Eric Marich

[57] ABSTRACT

A scrubber and heat recovery system for flue gas comprises a housing having a cooling section and a condensing section. An inlet is located near the cooling section and an outlet is located near the condensing section for the entry and exit of the flue gas. A cooling heat exchanger is located in the cooling section and a condensing heat exchanger is located in the condensing section for interactively contacting the flue gas. A perforated tray is located in the condensing section at the condensing heat exchanger for improving distribution of the gas and providing additional contact surface.

2 Claims, 2 Drawing Sheets

CONDENSING HEAT EXCHANGER SCRUBBING SYSTEM

FIELD AND BACKGROUND OF THE INVENTION

The present invention relates, in general, to the recovery of heat from flue gas in scrubber systems, and in particular, to a new and useful system for improving liquid and gas distribution in a scrubber using a sieve tray.

In the power plant field, condensing heat exchangers have been used for a number of years in order to recover heat from the flue gas produced by boilers. Through the use of condensing heat exchangers, some of the particulate, acid gases, metals and toxics associated with the flue gas can be removed from the flue gas.

A typical condensing exchanger-scrubber system consists of a downflow gas cooling section and an upflow gas condensing section. Reagent and/or additives are optional from improving tile removal efficiency of the scrubber systems.

The efficiency of the heat exchanger-scrubber system is largely dependent upon the cooling and contacting of the flue gas with the surface of the heat exchanger and the liquid condensate, reagent, additives, etc.

However, presently, no known system or method exists for providing a uniform liquid and gas distribution at the condensing heat exchanger.

SUMMARY OF THE INVENTION

The present invention provides an improved condensing heat exchanger scrubbing system for flue gas which utilizes a perforated tray in order to improve the distribution of the gas and provide additional contact with condensate and/or reagent and/or additives used in the scrubbing system.

The present invention comprises a heat recovery and scrubber system comprising a cooling section and a condensing section. A heat exchanger is located in the cooling section and the condensing section. Flue gas is passed into the system at the cooling section for interactively contacting the heat exchanger, and in turn, is passed through the system through the heat exchanger of the condensing section in order to remove particulate, acids, metals and toxics from the flue gas prior to tile flue gas exiting the system at an outlet near the condensing section.

The present invention includes a perforated tray in the condensing section near the condensing heat exchanger for improving gas distribution and adding contact surface through gas-liquid froth which accumulates on the perforated tray. The perforated tray is a sieve tray comprising a plate having a plurality of apertures and is divided into a plurality of compartments through the use of baffles on the plate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
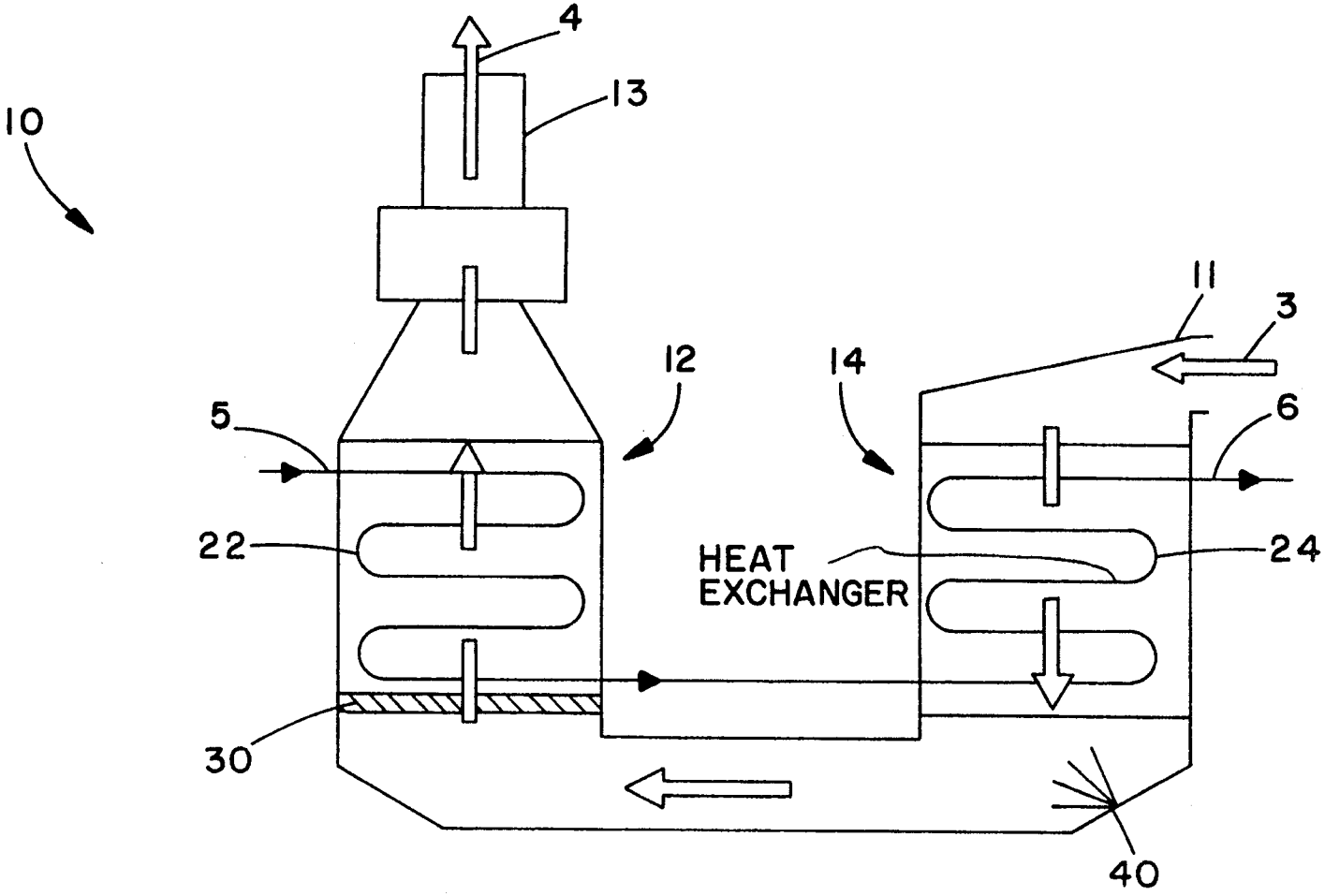
FIG. 1 is a schematic view of the present invention.

FIG. 1 illustrates a heat exchanger and scrubber system, generally designated 10, comprising a cooling section 14 and a condensing section 12. Inlet 11 is located near the cooling section 14 for the entry of unclean flue gas 3. A condensate heat exchanger 22 is located in the condensing section 12 and a cooling heat exchanger 24 is located in the cooling section 14. A cool liquid 5 is provided to the heat exchanger 22 at the condensing section 12, which is in turn provided to the heat exchanger 24 after exiting the heat exchanger 22. The liquid passed through the cooling heat exchanger 24 becomes a hot fluid shown at 6 which exits from the system at the cooling section 14.

Unclean flue gas 3 is provided to the cooling section 14 and interactively contacts the heat exchanger 24 for cooling the flue gas 3. The flue gas is then passed to the condensing section 12 for interactively contacting the condensing heat exchanger 22. Condensing heat exchanger 22 allows for particulate, acids, metals and toxics to be removed from the flue gas at the condensing section 12 prior to exiting the system 10 at outlet 13 where it exits the system 10 as a clean flue gas 4.

Treatment means 40 is optionally included in the system 10 for providing reagent and/or additives for improving contaminant removal efficiency of the system 10.

A porous tray 30 is located in the condensing section 12 near the condensing heat exchanger 22 for providing an improved contact surface for receiving condensate produced by the contact of the flue gas with the condensing heat exchanger 22. Sieve tray 30 provides an improved gas distribution by allowing the accumulation of gas-liquid froth on the tray 30.

Figure 2:
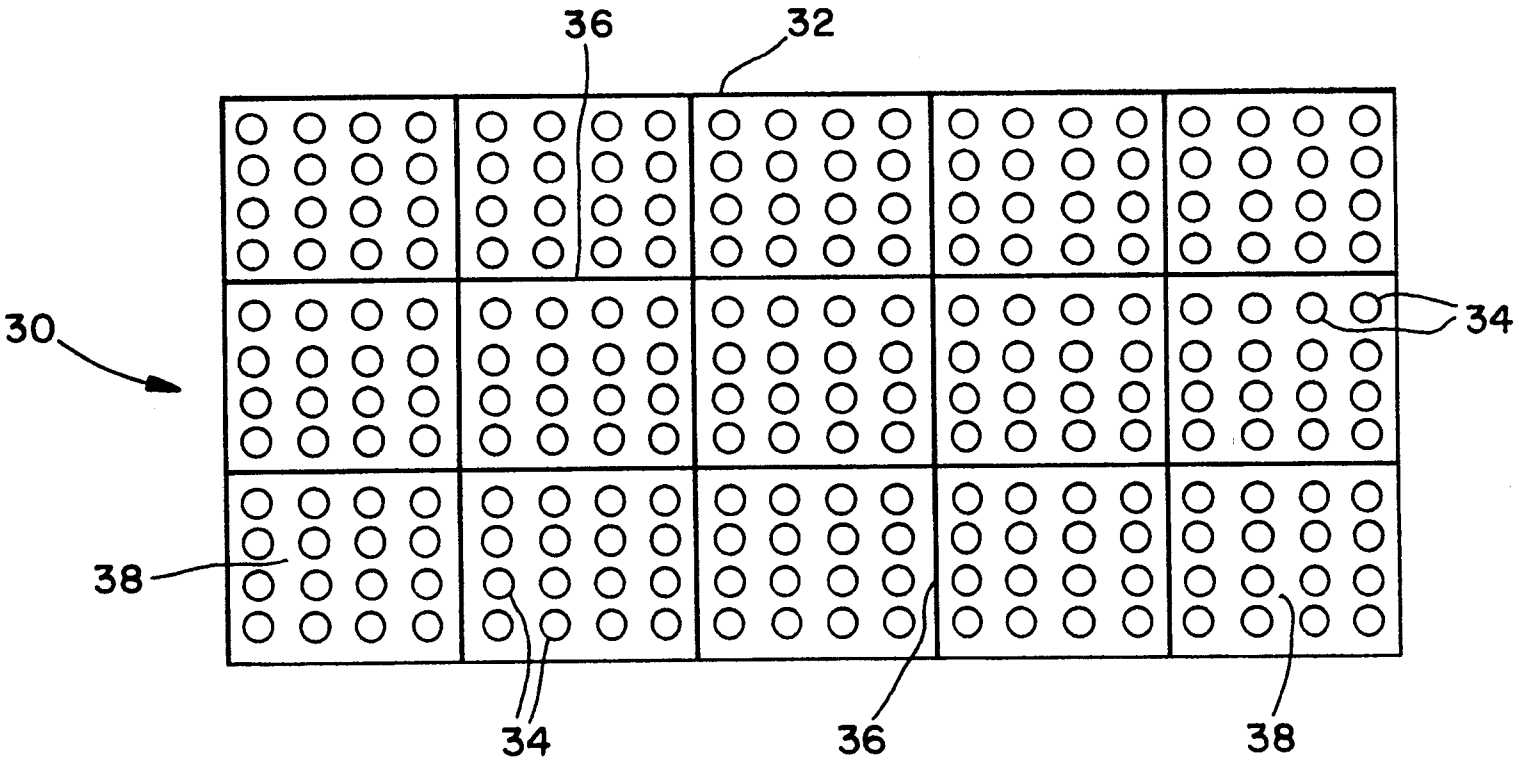
FIG. 2 is a top view of the plate of FIG. 1.

FIG. 2 shows the sieve tray 30 comprising a plate 32 having a plurality of perforations or apertures 34. A plurality of baffles 36 are arranged on the plate 32 which define a plurality of compartments 38 which provide more uniform liquid and gas distribution for the system 10. The sieve tray 30 can be located at any position along the condensing heat exchanger 22 within the condensing section 12.

The present invention provides a condensing heat exchanger scrubbing system 10 which utilizes the sieve tray 30 in order to improve the distribution of gas and provide additional contact surface for condensate and/or reagent and/or additives used in the system 10. For wet spray power scrubber systems, the present invention has proved to increase the removal of $SO_2$, particulate and acid gas as well as reduce cost associated with reagent usage, recirculated liquor flow, power and capital costs.

While specific embodiments of the invention have been shown and described in detail to illustrate the application of the principles of the invention, it will be understood that the invention may be embodied otherwise without departing from such principles.

I claim:

1. A scrubber and heat recovery system for a flue gas, the system comprising:

a housing having a cooling section and a condensing section, the housing also having an inlet near the cooling section and an outlet near the condensing section;

heat exchanger means disposed in the cooling section and the condensing section of the housing;

liquid means for providing a liquid to the heat exchanger means;

a perforated tray disposed in the condensing section at the heat exchanger means, the perforated tray including a plate having a plurality of apertures, and a plurality of baffles on the plate defining a plurality of compartments;

the housing for receiving the flue gas at the inlet, the flue gas being interactively contacted with the heat exchanger means of the cooling section and the heat exchanger means of the condensing section, and the flue gas exiting the housing at the outlet.

2. The system according to claim 1, including treatment means in the housing for cleaning a flue gas.

* * * * *